US006193209B1

(12) United States Patent
Bergman

(10) Patent No.: US 6,193,209 B1
(45) Date of Patent: Feb. 27, 2001

(54) CONTAINER FOR FORMING VOIDS IN CONCRETE

(76) Inventor: Ken Bergman, 1423 Symbo La., Walton, KY (US) 41094

( * ) Notice: Subject to any disclaimer, the term of this patent is extended or adjusted under 35 U.S.C. 154(b) by 0 days.

(21) Appl. No.: 09/245,703

(22) Filed: Feb. 6, 1999

(51) Int. Cl.[7] ..... B28B 7/30

(52) U.S. Cl. ..... 249/65; 249/177; 249/178; 249/183; 264/334

(58) Field of Search ..... 249/35, 65, 176, 249/177, 178, 179, 183; 264/31, 333, 334

(56) References Cited

U.S. PATENT DOCUMENTS

| | | | | |
|---|---|---|---|---|
| 934,666 | | 9/1909 | Goldkamp . | |
| 1,943,384 | * | 1/1934 | Hall | 249/65 |
| 2,206,410 | * | 7/1940 | Lally | 249/65 |
| 2,652,168 | * | 9/1953 | Nelson et al. | 249/65 |
| 2,949,658 | | 8/1960 | Conn . | |
| 3,104,441 | * | 9/1963 | Smith | 249/65 |
| 3,622,117 | * | 11/1971 | Lerman et al. | 249/65 |
| 3,648,963 | * | 3/1972 | Smith | 249/65 |
| 3,677,688 | * | 7/1972 | Morgan | 249/65 |
| 3,831,898 | * | 8/1974 | Sachs | 249/65 |
| 3,891,022 | | 6/1975 | Cola | 164/41 |
| 3,973,749 | * | 8/1976 | Friedl et al. | 249/65 |
| 3,999,322 | | 12/1976 | Kooker | 43/4 |
| 4,002,707 | | 1/1977 | Oram | 264/31 |
| 4,261,544 | * | 4/1981 | Addison | 249/93 |
| 4,342,441 | | 8/1982 | Maebara et al. | 249/65 |
| 4,515,271 | | 5/1985 | Auciello et al. | 206/519 |
| 4,594,205 | | 6/1986 | Wunderlich, Jr. | 264/31 |
| 4,629,155 | * | 12/1986 | Dula | 249/176 |
| 4,878,597 | * | 11/1989 | Haast | 249/65 |
| 5,314,653 | | 5/1994 | Haralambopoulos | 264/301 |

* cited by examiner

*Primary Examiner*—James P. Mackey
(74) *Attorney, Agent, or Firm*—Jim Blackwood

(57) ABSTRACT

An insert device for forming voids in concrete for various types of purposes, such as anchoring heavy machinery to a concrete foundation, is disclosed. A method for the use of the insert device is also disclosed.

2 Claims, 4 Drawing Sheets

CONTAINER FOR FORMING VOIDS IN CONCRETE

TECHNICAL FIELD

The present invention generally concerns the forming of voids in poured concrete, and in particular provides a device and a method for forming such voids.

BACKGROUND ART

The art of embedding an object in poured concrete by first forming a void in the concrete for receiving the object, and then securing the object in the void by some means, is old and well established. These voids are formed in a few different ways, such as by drilling a hole into concrete after the concrete has hardened, or by placing an insert of some kind into the concrete foundation before the concrete is poured and then removing the insert from the concrete once the concrete has hardened, thus leaving a void in the concrete. This art has applicability in several kinds of construction projects, from anchoring heavy machinery to a concrete foundation to building fencing.

Considering particularly the application of anchoring heavy machinery to a concrete foundation, it is customary in the art to form what are known as grout pits, a term meaning the filling of a void with grout, a concrete-like composition. After ascertaining the number and location of the voids that must be formed in order to properly anchor the machine in question, a number of inserts of some kind are placed into the desired positions and the concrete for forming the foundation is then poured. Once the concrete has hardened, the inserts are removed, thus forming voids in the concrete foundation. The machine is then secured by placing an anchor bolt from the machine into a void and then filling the void with grout, thus securing the anchor bolt in the proper location. Any other parts of the machine that need to be secured to the foundation are then secured in a similar manner.

Because a heavy machine creates a great deal of vibrational energy due to the relative motions of its respective parts, it is of the utmost importance that the machine be as securely anchored as possible. Experience has shown that, in order to produce an effective anchor, the grout pits must have a tapered shape, such that the bottom of the pit is wider than the top of the pit. Otherwise, the bond between the grout and the concrete foundation tends to deteriorate, and the quality of the product produced by the machine in question worsens, until eventually the machine may actually break away from the foundation, potentially causing injuries to the workers nearby as well as damage to both the machine itself and the building in which the machine is located.

At present, the inserts being used to form voids in concrete foundations are devices usually built by hand from conventional building materials, such as plywood. Such inserts are unsatisfactory for several reasons. Initially, there is the amount of time spent in constructing such inserts to the proper dimensions. Then there is the difficulty of removing such an insert from a void. This requires the use of hammers and other tools, and the stresses resulting from the removal of the devices may cause damage to the concrete foundation itself, which, to insure a proper installation, would require repeating the entire process. This, however is not usually done due to the time, labor and costs involved, the results being a poor installation of the machine due to an insecure mounting, and a resulting possibility of uncontrolled chatter or vibration marks in the finished parts. In addition, when it is desired to form grout pits along a line or at specified distances from one another, it is difficult to place these inserts in the proper locations, causing time delays and often causing slight errors in the placement of the inserts, thus weakening the effectiveness of the grout pits in anchoring the machine.

There are other types of devices at use in the art. An example of such a device is found in the Auciello et al. Patent, U.S. Pat. No. 4,515,271. This patent shows a tubular insert device with an internal line of scoring, allowing the separation of an upper and lower closure element by use of a holder tab. After a void in a concrete foundation is made, the device is removed by pulling on the holder tab, which lifts up the upper closure element and allows removal of the device. To facilitate packing and storing the devices, they are tapered such that the bottom of the device is wider than the top. In addition, FIG. 8 of the Auciello Patent shows the edges of the holder tabs serving as a measuring point to insure proper placement of the devices.

OBJECTS AND SUMMARY OF THE INVENTION

It is an object of the invention to provide an insert device for forming voids in concrete that comes in the proper shape for forming a void, thus requiring no construction work on the part of a user of the container.

It is another object of the invention to provide an insert device that can be easily removed from a void in concrete once it is formed.

It is yet another object of the invention to provide an insert device having a reliable and known strength in keeping its shape when subjected to the weight of poured concrete.

It is a further object of the invention to provide a method of using an insert device to form voids in concrete.

These objects are met by providing an insert device made from a semi-rigid material which can be filled with a fluid, typically water, and then used to form a void in poured concrete. This insert device, which will hereafter be referred to as a container, can then be removed from the hardened concrete by removing the fluid from the container and pulling the container from the concrete, leaving the void.

DETAILED DESCRIPTION OF THE INVENTION

Figure 1:
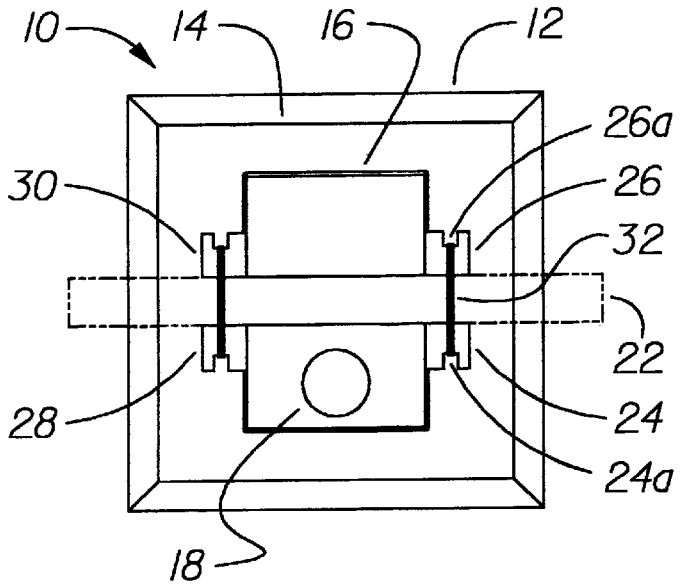
FIG. 1 shows a top view of an embodiment of the present invention, with a guide being tied to a boss.
Figure 2:
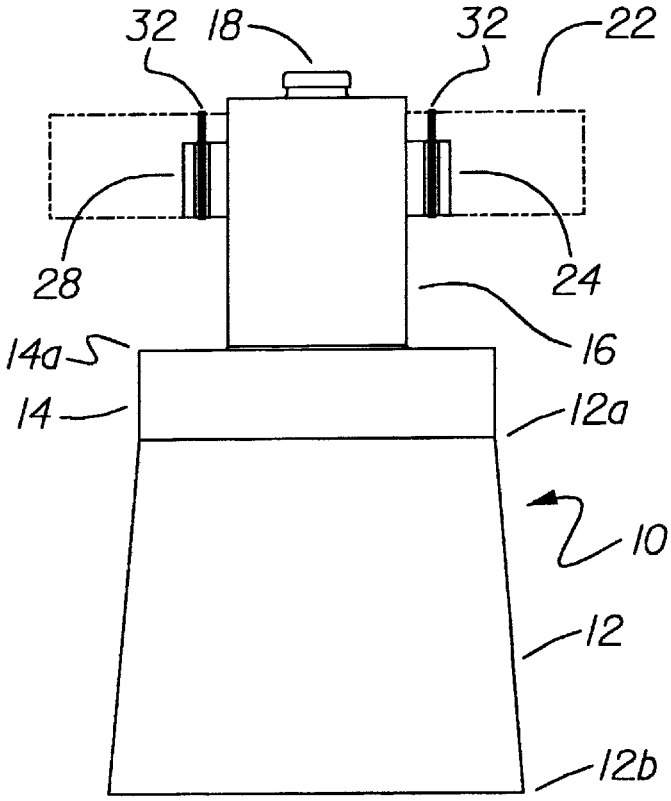
FIG. 2 shows a side view of the embodiment of the present invention shown in FIG. 1, with the guide shown in perpendicular to the viewer.

Referring now to the drawings, FIGS. 1–4 all show an embodiment of the present invention from different perspectives. These drawings show a container 10 having a body section 12, a shoulder section 14, and a head section 16. The body section 12 is tapered such that the bottom end 12*b* of the body section is wider than the top end 12*a*. The head section 16 has an opening (not shown) covered by a cap 18 and a slot 20 for receiving a guide 22, which is shown in the drawings as a piece of lumber. The head section 16 has a pair of bosses 24, 26 on one side 16*a* of the head section and another pair of bosses 28, 30 on the opposite side 16*b* of the head section 16. A tie 32 is shown wrapping around slots 24*a*, 26*a* in the bosses 24, 26 and the guide 22 itself, thus securing the guide 22 in place.

The container 10 is made of a semi-rigid material, defined here as a material which has a definite shape before being filled with fluid and substantially retains that shape after being filled with a fluid, and which does not allow fluid, such as water, to leak through it. The preferred material would be a plastic, similar to the type of plastic used in making milk jugs. However, any material meeting the above requirements could be used.

Figure 5:
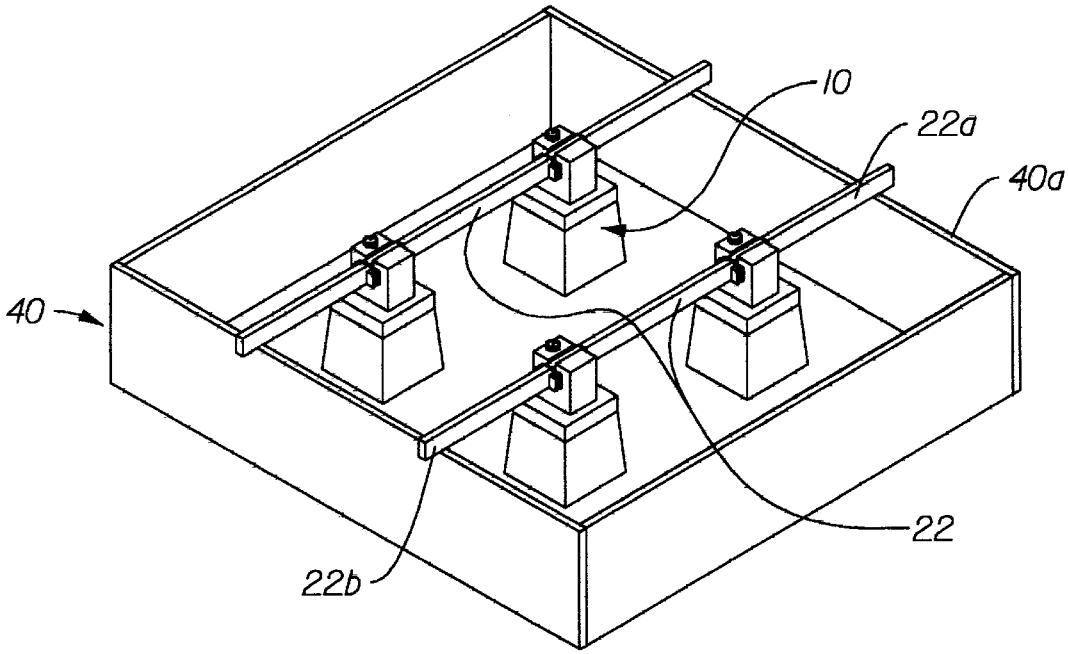
FIG. 5 shows two rows of embodiments of the present invention in place in a concrete form and ready for use.

Referring now to FIG. 5, the usage of the present invention can be described. This drawing shows two rows of containers 10 fastened to guides 22. These guides 22 provides a handy method of insuring that the containers 10 are in a straight line and, by securing of the guide 22 at its ends 22*a*, 22*b* in some fashion before the concrete is poured, helps to insure that the weight of the concrete does not cause any movement of the containers 10, which are fastened to the guide 22 by ties 32 as seen in FIGS. 1 through 4. Typically, the guides 22 will be secured by placing their ends 22*a*,22*b* on the top edge 40*a* of a concrete form 40, which is a device used to contain the concrete once it has been poured. Thus, the containers 10 are in effect being suspended from the guides 22. By measuring the guides 22 before attaching the containers 10 with the ties 32, it is also possible to use locations marked on the guide 22 to insure that the containers 10 are properly spaced in relation to each other.

Figure 3:
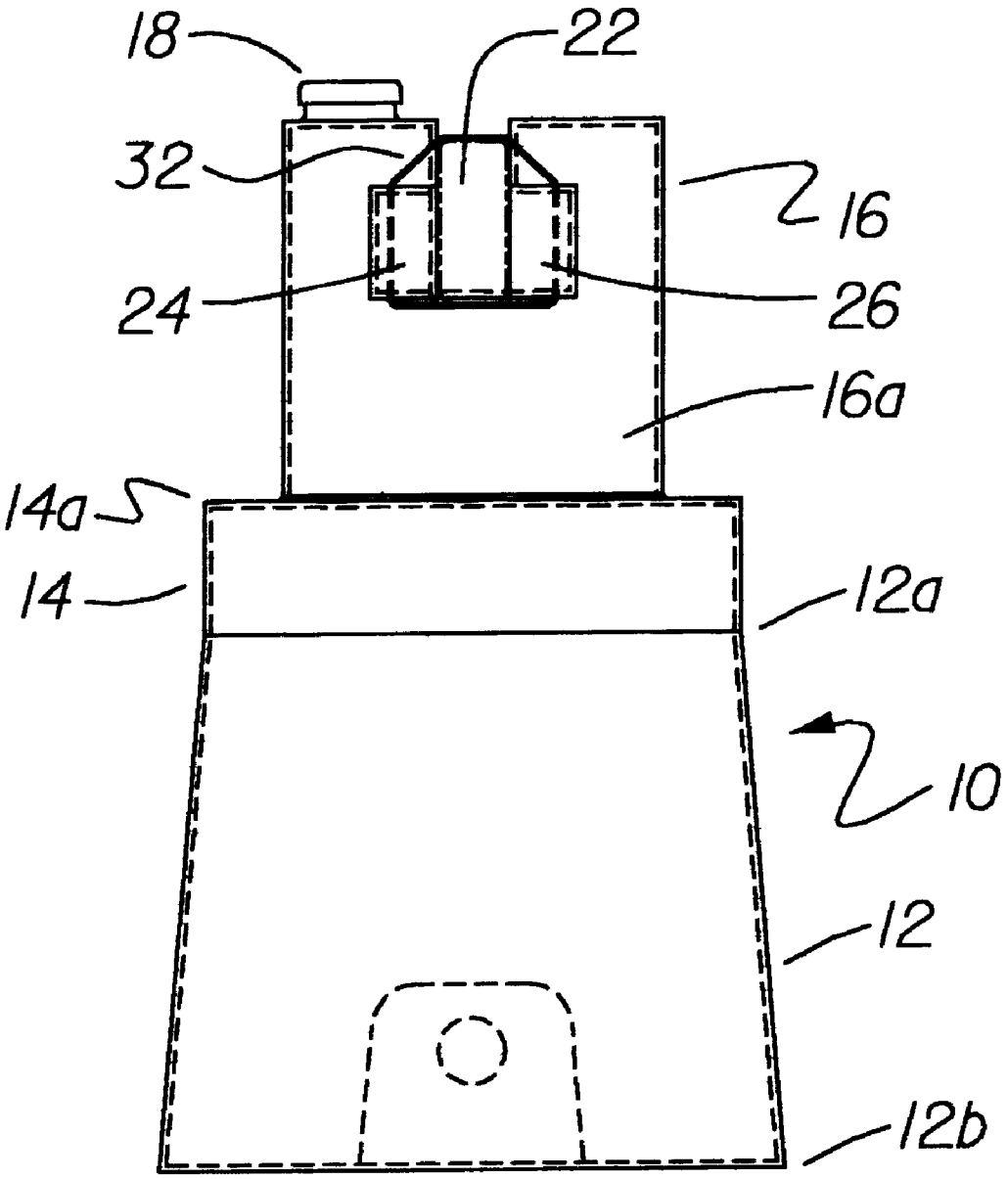
FIG. 3 shows a side view of the embodiment of the present invention shown in FIG. 1, with the guide shown in parallel to the viewer.
Figure 4:
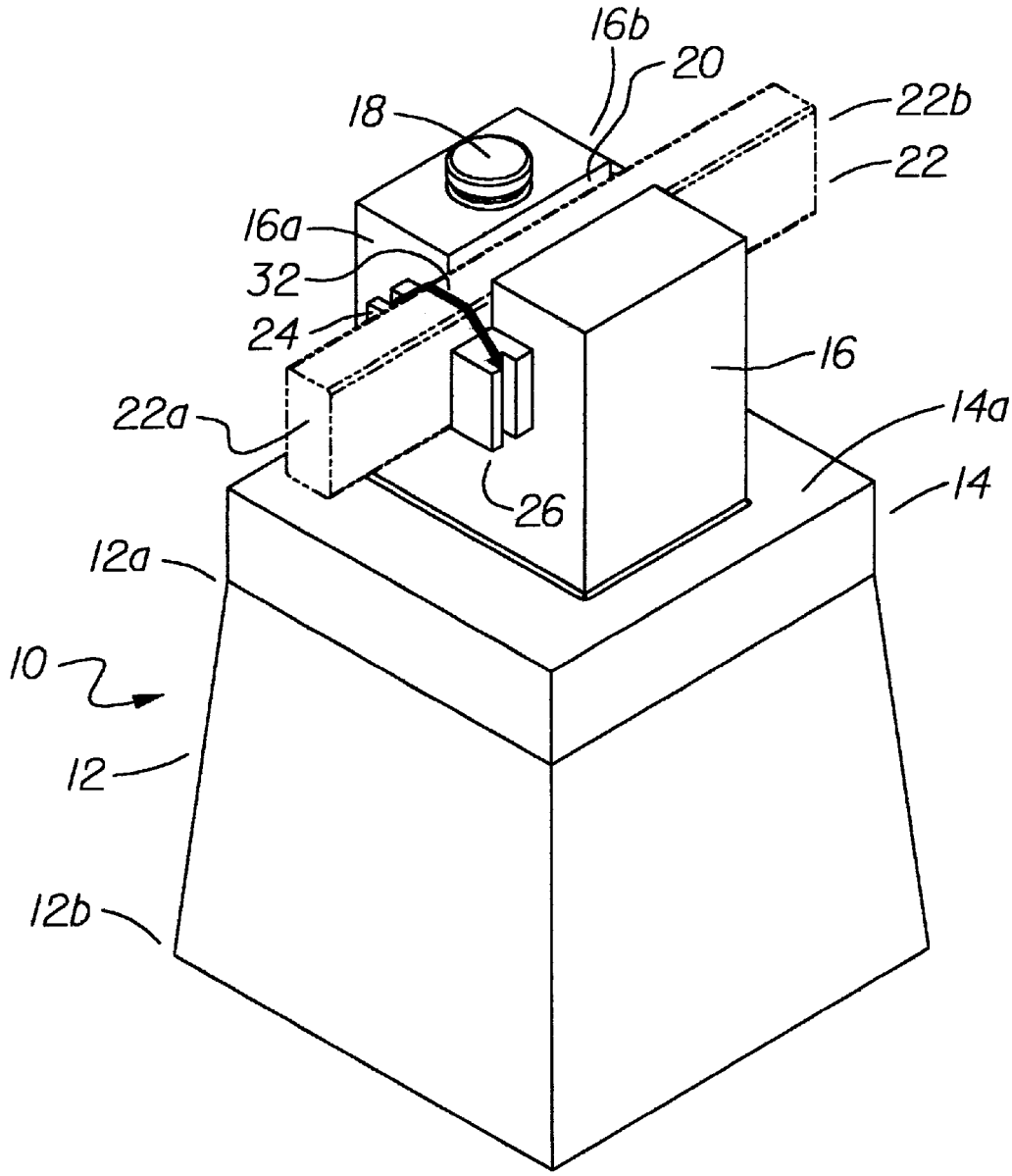
FIG. 4 is a perspective view of the embodiment of the present invention shown in FIG. 1.

Once the containers 10 are in the proper position and secured, a fluid such as water is poured into the opening (not shown) in the head section 16 of the containers 10. Once the containers 10 are filled with fluid, the caps 18 are secured and the concrete can be poured. The concrete is poured to the desired height, which generally would be beneath the level of the top 14*a* of the shoulder section 14, for reasons that will be explained later. After the concrete has hardened sufficiently, the caps 18 of the containers 10 can be removed and the fluid can be removed, either by use of some type of machine, such as a pump, or by manually siphoning off the fluid. While the containers 10 are resistant to deformation caused by the weight of the concrete when filled with the fluid, allowing it to maintain its form while the concrete is hardening, once the fluid is removed from the containers 10, the semi-rigid material is easily collapsible, thus allowing the containers 10 to be removed from the concrete in a number of ways. The containers 10 can be removed by simply pulling the guide 22 itself upwards, thus causing the containers 10 to collapse, or by removing the ties 32 from the guide 22, thus freeing the containers 10 from the guide 22, and then simply pulling the containers 10 out of the concrete by hand. As shown in FIG. 3, a handle 34 for grasping when hand removal of a container 10 is desired can be located on the interior 12*c* of the body section 12, thus allowing for easier removal of a container 10. Upon the removal of the containers 10, the desired voids are formed in the concrete foundation and the anchoring of a machine by use of grout can occur.

In order to facilitate the removal of the containers 10 from the concrete, it is generally recommended that the concrete not be poured above the top 14*a* of the shoulder section 14 of the containers, although exceptions may be made. The shoulder section 14 provides a clear delineation between the body section 12 and the head section 16 and is much less tapered, if at all, than the body section 12, thus facilitating easier removal of the container 10 from concrete. However, it is also envisioned that there could be embodiments lacking a shoulder section 14 altogether, with a body section 12 and a head section 16 only, in which case it would be desirable to not have the concrete height exceed that of the body section 12.

The above description is the best mode envisioned by this inventor for using a series of embodiments of the present invention. However, while recommended, the use of a guide 22 is not absolutely required in order to use embodiments of the present invention. In addition, in applications only requiring that a single void need to be formed, the use of a guide 22 might not be required. Thus, in these situations, the container 10 would not need to have a slot 20 or any bosses 24, 26, 28, 30 in the head section 16 of the container 10.

Figure 6:
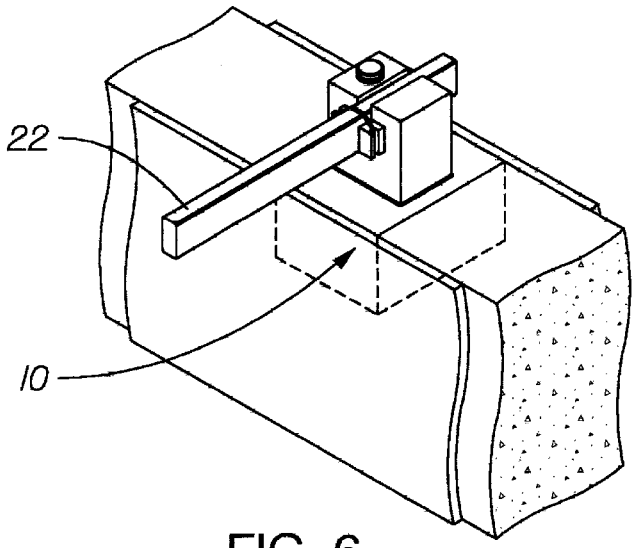
FIG. 6 is a perspective view of an alternate embodiment of the invention for use with a foundation wall.

In addition, the above described best mode of the invention, with only minor alterations as would be obvious to one of ordinary skill in the art may be utilized to form cavities in concrete for a number of purposes, such as in a support wall or foundation wall, for the purpose of holding the end of a support beam. An illustration of such an embodiment is given in FIG. 6, wherein the guide 22 rests on top of a set of common foundation wall forms 42, the top of the container 10 is similar in all respects to the preferred embodiment, and the bottom part of the container 10 has sides in which a taper is not required.

In light of the above specification, there are several possible modifications and variations to embodiments of the present invention. Accordingly, it should be understood that the claims, as supported by the teachings of this specification, define the scope of the present invention.

I claim:

1. A container for forming a void in concrete comprising:

a body section made from a semi-rigid material, with the body section having a bottom end and a top end, with the body section being tapered in shape such that the bottom end of the body section is wider than the top end of the body section, a head section made from a semi-rigid material, with the head section having an opening for receiving fluid, and a handle on the interior of the body section.

2. A container for forming a void in a concrete support wall comprising: having a bottom end and a top end, a head section made from a semi-rigid material, with the head section having an opening for receiving fluid, and a handle on the interior of the body section.

* * * * *